US006025035A

United States Patent [19]

Seo et al.

[11] Patent Number: 6,025,035

[45] Date of Patent: Feb. 15, 2000

[54] ELECTROSTATIC COATING METHOD AND COATING FILM

[75] Inventors: Shinji Seo, Hirakata; Hiroshi Oda, Toyonaka; Kazuyoshi Uemura, Neyagawa, all of Japan

[73] Assignee: Nippon Paint Co., Ltd., Osaka, Japan

[21] Appl. No.: 09/140,600

[22] Filed: Aug. 27, 1998

[30] Foreign Application Priority Data

Aug. 27, 1997 [JP] Japan ..... 9-247932

[51] Int. Cl.[7] ..... B05D 1/06

[52] U.S. Cl. ..... 427/470; 427/475; 427/485; 427/486; 428/416

[58] Field of Search ..... 427/470, 475, 427/486; 428/416

[56] References Cited

U.S. PATENT DOCUMENTS 5,334,631 8/1994 Durand ..... 523/459
5,552,191 9/1996 Horinka et al. ..... 427/475
5,747,150 5/1998 Yamamoto et al. ..... 428/220

FOREIGN PATENT DOCUMENTS 525867 2/1993 European Pat. Off. .

*Primary Examiner*—Fred J. Parker
*Attorney, Agent, or Firm*—Pollock, Vande Sande & Amernick

[57] ABSTRACT

This invention relates to a method for forming a coating film which comprises applying an epoxy resin powder coating (A) onto a substrate by electrostatic coating, half-baking the resultant uncured coat, applying a polyester resin powder coating (B) onto the half-baked coat by electrostatic coating, and baking the two uncured coats simultaneously, wherein the epoxy resin powder coating (A) and the polyester resin powder coating (B) is such that the gel time ratio [epoxy resin powder coating (A)]/[polyester resin powder coating (B)] at 180° C. is 1/1 through 1/5, the gel time of the epoxy resin powder coating (A) at 180° C. is 40 to 400 seconds, and the gel time of the polyester resin powder coating (B) at 180° C. is not over 500 seconds.

7 Claims, No Drawings

ELECTROSTATIC COATING METHOD AND COATING FILM

FIELD OF THE INVENTION

The present invention relates to a method for forming a coating film having an improved resistance to corrosion, weather, and chipping and an excellent appearance and to a coating film formed by the above method.

BACKGROUND OF THE INVENTION

Powder coatings have been attracting a great deal of attention in recent years as eco-friendly paints, because powder coatings, which are solvent-free coatings, do not cause environmental pollution and are able to save resources. The scope of use of such powder coatings in place of solvent-based paints is expanding and their consumption is also on the steady increase.

Powder coatings have so far been used not only on automotive bodies, residential building materials, etc. but also in the field of road-related materials such as guardrails and road signs. However, none of the conventional powder coatings are capable of providing all the necessary properties for outdoor use such as corrosion resistance, weather resistance, chipping resistance, and the appearance of the coating film. For example, epoxy resin powder coatings offer corrosion resistance and chipping resistance sufficiently but are not fully satisfied in weather resistance. Polyester resin powder coatings and acrylic resin powder coatings are satisfactory in weather resistance but not satisfactory enough in the resistance to corrosion and chipping. Epoxy-polyester resin powder coatings fail to satisfy any of those properties.

Therefore, it has been investigated that formation of a multi-layer coating film by using two or more kinds of powder coatings which have different abilities improves these properties of film. In this connection, the forming of films from powder coatings is generally carried out in a procedure baking after each coating. For example, it is general that so-called 2-coat/2-bake method is adopted for formation of two layered film. However, since the multiple coating by this process takes much time, it is desired to develop a coating technology using the 2-coat/1-bake method, that is to say a coating process which comprises applying two coats successively and then curing both coats at the same time, for reduction of the processing time and conservation of resources.

However, in the 2-coat/1-bake system, the flowability in the bottom layer is inhibited by the top layer so that the coating particles, particularly coarse particles, in the bottom layer cannot flow well, thus giving rise to thin film spots in the top layer or the powders in the bottom layer migrate onto the surface of the top layer to detract from the final appearance of the coating film.

Japanese Kokai Publication Hei-6-304519 discloses a method of forming a multi-layer coating films which comprises applying a polyester resin powder coating or an acrylic resin powder coating on the uncured coating film from an epoxy resin powder coating and heat-curing the two-coats at the same time. In this method, the chipping resistance, corrosion resistance, and weather resistance of the final coating film can be improved by designing the coatings in such a manner that the surface tension of the powder coating for the top layer will be lower than that of the powder coating for the bottom layer. However, because the difference of curing speed between the top layer and the bottom layer causes strain and/or shrinkage of the coating film, this method failed to accomplish a sufficient improvement in appearance.

As a means for improving the appearance of a coating film on formation from powder coatings by the 2-coat/1-bake method, Japanese Kokai Publication Hei-6-256692 discloses a coating method which comprises defining the flowability in melting stage of the powder coatings forming the top and bottom layers, respectively, so that the flowability will be larger in the top layer. However, since the top layer takes a long time to be cured, this coating method gives no film which is cured completely within a practically acceptable curing time. So chipping resistance, weather resistance and corrosion resistance of this film are not good.

SUMMARY OF THE INVENTION

It is an object of the present invention to provide an efficient method of forming a coating film which is satisfied in all of corrosion resistance, weather resistance, chipping resistance and an excellent appearance.

The present invention is directed to a method for forming a coating film which comprises applying an epoxy resin powder coating (A) onto a substrate by electrostatic coating, half-baking the resultant uncured coat, applying a polyester resin powder coating (B) onto the half-baked coat by electrostatic coating, and baking the two uncured coats simultaneously, wherein the epoxy resin powder coating (A) and the polyester resin powder coating (B) is such that the gel time ratio [epoxy resin powder coating (A)]/[polyester resin powder coating (B)] at 180° C. is 1/1 through 1/5, the gel time of the epoxy resin powder coating (A) at 180° C. is 40 to 400 seconds, and the gel time of the polyester resin powder coating (B) at 180° C. is not over 500 seconds.

DETAILED DESCRIPTION OF THE INVENTION

In accordance with the present invention, there is provided a method for forming a coating film which comprises applying an epoxy resin powder coating (A) onto a substrate by electrostatic coating, half-baking the resultant uncured coat, applying a polyester resin powder coating (B) onto the half-baked coat by electrostatic coating, and baking the two uncured coats simultaneously, wherein the epoxy resin powder coating (A) and the polyester resin powder coating (B) is such that the gel time ratio [epoxy resin powder coating (A)]/[polyester resin powder coating (B)] at 180° C. is 1/1 through 1/5, the gel time of the epoxy resin powder coating (A) at 180° C. is 40 to 400 seconds, and the gel time of the polyester resin powder coating (B) at 180° C. is not over 500 seconds.

The type of substrate surface to which the method for forming a coating film of the invention can be applied is not particularly restricted but includes metal such as phosphoric acid-treated steel, galvanized steel, cold-rolled steel, aluminum, stainless steel, zinc phosphate-treated steel, and iron phosphate-treated steel sheets and other members. Those substrates can be used as such, or after coating of a rust-preventive paint or an electrodeposition paint or after a surface treatment. Those coatings and treatments can be carried out alone or in combination. In the method for forming a coating film of the invention, since two kinds of powder coatings are applied to a substrate surface by electrostatic coating, the layers of the under coat and treatment are preferably thin in the viewpoint of coatability.

The powder coatings for use in the present invention are an epoxy resin powder coating (A) and a polyester resin powder coating (B). The epoxy resin powder coating (A)

and polyester resin powder coating (B) are such that their gel time ratio [epoxy resin powder coating (A)]/[polyester resin powder coating (B)] at 180° C. is 1/1 through 1/5. The gel timementioned above is a parameter defined in JIS K6909 and means the time required for conversion of a sol to a gel. The gel time of a powdery resin is usually measured as follows. Thus, 0.5 g of a resin sample is placed on a steel sheet of 180° C. and, using a stainless steel spatula, spread into a circle about 3 cm in diameter and kneaded every about 1 second and the time until no threading is observed any longer between the sample and the spatula is determined.

If the ratio of the gel time of the polyester resin powder coating (B) at 180° C. to the gel time of the epoxy resin powder coating (A) at 180° C. is less than 1, a large strain occurs to detract from the appearance of the coating film and the chipping resistance of the film is also decreased. If the above ratio exceeds 5, a large shrinkage occurs in the coating film and the chipping resistance is also decreased. Therefore, the above range should be restricted.

The gel time of the epoxy resin powder coating (A) should be 40 to 400 seconds at 180° C. If the gel time is less than 40 seconds, the powder coating will not be sufficiently melted so that the flatness of the coat becomes worse. On the other hand, if the gel time exceeds 400 seconds, the curing time of the coat will become so long that only insufficient cure can be obtained within a practically acceptable cure time and the chipping resistance, weather resistance, and corrosion resistance will not be satisfactory. Therefore, the above range should be respected.

Preferably, the 90% volume particle diameter of the epoxy resin powder coating (A) should not be greater than 70 μm. If the 90% volume particle diameter exceeds 70 μm, the coarse particles will not be melted so that thin-film spots will be produced in the top layer or the powder coating in the bottom layer will migrate onto the top layer to cause graining, thus detracting from the appearance of the coating film.

The term "90% volume particle diameter" means the maximum particle diameter in the fraction comprising 90% of all the particles as counted from the smaller end of the scale in the particle size distribution, and means that, for example, a powder with a 90% volume particle diameter of x μm contains particles exceeding x μm in diameter in a proportion of 10% based on the total population of particles. Therefore, defining a 90% volume particle diameter value for the epoxy resin powder coating (A) results in limiting the proportion of particles having particle diameters exceeding the defined value to 10% of the total population. By definition of the 90% volume particle diameter, not so many coarse particles which do not melt under the heat applied for curing are included. Incidentally, when the particle size distribution is a normal distribution, a powder coating with a 90% volume particle diameter of 70 μm corresponds to a powder coating with a volume average particle diameter of 35 to 50 μm.

The preferred volume average particle diameter of the epoxy resin powder coating (A) is 10 to 60 μm. If it is less than 10 μm, the productivity of the powder coating will become drastically worse and the flowability of the powder coating be also decreased, making the powder coating difficult to work with. If the particle diameter of (A) exceeds 60 μm. the coarse particles will not flow well, with the result that thin-film spots are formed in the top layer or the powder coating of the bottom layer migrates onto the top layer to cause graining and detract from the appearance of the coating film. The epoxy resin powder coating (A) is a thermosetting powder coating containing an epoxy resin and a curing agent as film-forming components.

The epoxy resin powder coating (A) can be prepared by kneading the epoxy resin and the curing agent optionally together with a curing catalyst, a pigment, a surface conditioner, acrylic resin and other additives.

The epoxy resin mentioned above is not particularly restricted to any specific kind but is preferably a compound having two or more oxirane groups within its molecule. As typical compounds, glycidyl ester resins, glycidyl ether resins such as bisphenol A-epichlorohydrin condensate, alicyclic epoxy resins, flocculent aliphatic epoxy resins, bromine-containing epoxy resins, phenol-novolak epoxy resins, cresol-novolak epoxy resins, etc. can be mentioned.

The curing agent for the epoxy resin is not particularly restricted but includes phenolic hydroxyl-containing epoxy resins, amine type curing agents, dicyandiamide, imidazole compounds, imidazoline compounds, etc. Particularly preferred are epoxy resins containing phenolic hydroxyl groups.

In the present invention, the epoxy resin powder coating (A) obtained by above-mentioned method is preferably a phenol-curable epoxy resin powder coating which contributes to chipping resistance of the coating film.

The curing catalyst mentioned above is not particularly restricted but includes tin compounds, imidazole compounds, and imidazoline compounds. The above-mentioned pigment is not particularly restricted, either, but includes color pigments such as titanium dioxide, iron oxide red, iron oxide, carbon black, copper phthalocyanine blue, copper phthalocyanine green, quinacridone dyes, azo dyes, etc. and extender pigments such as talc, calcium carbonate, precipitated barium sulfate, silica, and so on.

The above-mentioned surface conditioner is not particularly restricted but includes dimethylsilicone, methylsilicone, and acrylic oligomers, among others.

The other additives are not particularly restricted, but include cure accelerators, plasticizers, ultraviolet absorbers, antioxidants, pigment dispersants; benzoin, and benzoin derivatives available on addition of 1 to 3 kinds of functional groups to benzoin.

The polyester resin powder coating (B) for use in the present invention is a coating with a gel time of not over 500 seconds at 180° C. If the limit of it exceeds 500 seconds, the cure time will be so protracted that a sufficient curing effect cannot be obtained within a practically acceptable cure time and the chipping resistance, weather resistance and corrosion resistance of the coating film will be insufficient and unreasonable. Therefore, the above-mentioned range should be respected.

The preferred volume average particle diameter of the polyester resin powder coating (B) is 5 to 30 μm. If it is less than 5 μm, the productivity of the powder coating is decreased and the flowability of the powder is adversely affected, making the powder difficult to work with. If 30 μm is exceeded, the flatness and smoothness of the coating film are adversely affected. Therefore, they are not preferable. The polyester resin powder coating (B) is a thermosetting powder coating which contains a polyester resin and a curing agent as film-forming components. Production of this polyester resin powder coating (B) can be carried out in the same manner as the production of the epoxy resin powder coating (A). Thus, the polyester resin powder coating (B) can be obtained by kneading the polyester resin and the curing agent optionally together with a curing catalyst, a pigment, a surface conditioner, acrylic resin, and other additives.

The above-mentioned polyester resin is not particularly restricted but includes the polyester resins obtainable by polymerizing polyhydric alcohols such as ethylene glycol, propanediol, pentanediol, hexanediol, neopentyl glycol, trimethylolpropane, pentaerythritol, etc. with carboxylic acids such as maleic acid, terephthalic acid, isophthalic acid, phthalic acid, succinic acid, glutaric acid, adipic acid, sebacic acid, β-hydroxypropionic acid, etc. in the known manner.

The curing agent for the polyester resin is not particularly restricted but includes blocked isocyanate compounds and amino resins etc.

In the present invention, the epoxy resin powder coating (A) is applied onto a substrate by electrostatic coating, and half-baking the resultant uncured coat, further applying a polyester resin powder coating (B) onto the half-baked coat by electrostatic coating, and baking the two uncured coats simultaneously.

The electrostatic coating with the epoxy resin powder coating (A) and the polyester resin powder coating (B) can be respectively carried out using a known electrostatic coating machine or the like. For insuring good corrosion resistance and chipping resistance, the epoxy resin powder coating (A) is preferably applied in a cured film thickness of 10 to 70 μm, particularly 10 to 50 μm.

The resultant uncured coat of the epoxy resin powder coating (A) is half-baked. Preferably, the half-baking is performed at 75 to 140° C. for 1 to 15 minutes. The term "half-bake" means that a coat is treated by heating so that particles on the surface of uncured coat of the epoxy resin powder coating (A) can be melted but not completely cured. Without half-baking, appearance of the coating film becomes worse.

The above-mentioned polyester resin powder coating (B) is applied, by electrostatic coating, onto the half-baked coat of the epoxy resin powder coating (A). For insuring good weather resistance, the polyester resin powder coating (B) is preferably applied in cured film thickness of 20 to 80 μm.

The two uncured coats, the half-baked coat of the epoxy resin powder coating (A) and the uncured coat of the polyester resin powder coating (B) are baked simultaneously. The above-mentioned baking is carried out preferably at 130 to 220° C. for 10 to 60 minutes for a complete cure of the coating film containing two different powder coatings.

In the present invention, an electrodeposition coating, a solid color coating, a metallic color coating, or a clear coating may be optionally applied onto the coating film obtained as above. Those coatings can be applied each independently to form a single layer or in a combination to form a plurality of layers. The coating film obtained by the method for forming a coating film of the invention has a good adhesive property for the above-mentioned coatings.

Also, the method for forming a coating film of the invention can be used for so-called "Powder/Electrodeposition Inverse-Coating System". In this system, a powder coating is firstly applied to a substrate, then an electrodeposition coating, which has throwing power, is applied to the part of the substrate which is difficult to be coated by the powder coating.

When the method for forming a coating film of the invention is used for the Powder/Electrodeposition Inverse-Coating System, between applying the polyester resin powder coating (B) and baking the two uncured coat simultaneously, the resultant coat of the polyester resin powder coating (B) is half-baked, and an electrodeposition coating is applied onto the substrate. The half-baking is preferably performed as the same as the half-baking condition of the epoxy resin powder coating (A).

The electrodeposition coating for Powder/Electrodeposition Inverse-Coating System above-mentioned is not particularly restricted. A cationic type of the electrodeposition, such as an amino-modified epoxy resin with a curing agent as a blocked isocyanate, is preferred. The condition of electrodeposition can be applied to the general one for an automotive body.

The method for forming a coating film of the invention finds application in a variety of uses where corrosion resistance, weather resistance, and chipping resistance are required, for example in the coating of road-related materials such as guardrails and road signs, automotive bodies, and residential building materials.

In the method for forming a coating film of the invention comprising applying the epoxy resin powder coating (A), half-baking the uncured coat, and applying the polyester resin powder coating (B) thereon, the chipping resistance and appearance of the coating film are satisfactory, and because the coating film consists of an epoxy resin film and a polyester resin film, it offers good corrosion resistance and weather resistance. Furthermore, because the method for forming a coating film of the invention is so called 2-coat/1-bake method which comprises applying an epoxy resin powder coating (A) onto a substrate by electrostatic coating, half-baking the resultant uncured coat, applying a polyester resin powder coating (B) onto the half-baked coat by electrostatic coating, and baking the two uncured coats simultaneously, all coating process can be shortened and the energy cost can be reduced, compared with the conventional 2-coat/2-bake method.

The gel time of epoxy resin powder coating (A) and the gel time of polyester resin powder coating (B) are respectively restricted, the gel time ratio of the epoxy resin powder coating (A) to the polyester resin powder coating (B) is restricted to A/B=1/1 through 1/5, and half-baking of the uncured coat (A) is carried out. Therefore, despite use of the 2-coat/1-bake system, no cure shrinkage occurs in the respective films so that the appearance of the final coating film can be improved. Moreover, still greater improvements can be obtained in corrosion resistance and weather resistance. Furthermore, because neither the epoxy resin powder coating (A) nor the polyester resin powder coating (B) contains coarse particles, a further improvement in appearance of the coating film can be realized.

The coating film of the invention is a coating film formed by the above-described method for forming a coating film of the invention.

Since the coating film of the invention is very satisfactory in corrosion resistance, weather resistance, chipping resistance, and appearance of the coating film, articles covered with the coating film of the invention are useful for various applications such as road-related materials such as guardrails and road signs and other outdoor uses such as residential building materials, automotive bodies, and so on.

EXAMPLES

The following examples illustrate the present invention in further detail without limiting the scope of the invention.

Production Example 1

Production of an Epoxy Resin Powder Coating Composition

Using Supermixer (Nippon Spindle Mfg.), 100 parts by weight of epoxy resin (EPIKOTE 1004F, Yuka-Shell Epoxy), 30 parts by weight of curing agent (EPICURE 170, Yuka-Shell Epoxy), 0.3 parts by weight of curing catalyst (CURESOL 2MZ, Shikoku Kasei Kogyo), 5 parts by weight of calcium carbonate, and 20 parts by weight of titanium dioxide were admixed for about 1 minute. Then, using Co-kneader (Buss), the mixture was melt-kneaded at about 95° C. After cooling at room temperature and crude pulverization, the pulverizate was further comminuted with Atomizer (Fuji Paudal) and classified to remove coarse particles with a pneumatic classify apparatus DS-2 (Nippon Pneumatic) and thereby provide an epoxy resin powder coating composition (1) with a 90% volume particle diameter of 62 μm and a gel time of 71 seconds at 180° C.

Production Example 2

Production of an Epoxy Resin Powder Coating Composition

Using Supermixer (Nippon Spindle Mfg.), 100 parts by weight of epoxy resin (EPIKOTE 1003F, Yuka-Shell Epoxy), 30 parts by weight of curing agent (EPICURE 170, Yuka-Shell Epoxy), 0.05 parts by weight of curing catalyst (CURESOL 2MZ, Shikoku Kasei Kogyo), 5 parts by weight of calcium carbonate, and 20 parts by weight of titanium dioxide were admixed for about 1 minute. Then, using Co-kneader (Buss), the mixture was melt-kneaded at about 95° C. After cooling at room temperature and crude pulverization, the pulverizate was further comminuted with Atomizer (Fuji Paudal) and classified to remove coarse particles with a pneumatic classify apparatus DS-2 (Nippon Pneumatic) and thereby provide an epoxy resin powder coating composition (2) with a 90% volume particle diameter of 60 μm and a gel time of 285 seconds at 180° C.

Production Example 3

Production of an Epoxy Resin Powder Coating Composition

Using Supermixer (Nippon Spindle Mfg.), 100 parts by weight of epoxy resin (EPIKOTE 1004F, Yuka-Shell Epoxy), 30 parts by weight of curing agent (EPICURE 170, Yuka-Shell Epoxy), 2.4 parts by weight of curing catalyst (CURESOL C17Z, Shikoku Kasei Kogyo), 5 parts by weight of calcium carbonate, and 20 parts by weight of titanium dioxide were admixed for about 1 minute. Then, using Co-kneader (Buss), the mixture was melt-kneaded at about 95° C. After cooling at room temperature and crude pulverization, the pulverizate was further comminuted with Atomizer (Fuji Paudal) and classified to remove coarse particles with a pneumatic classify apparatus DS-2 (Nippon Pneumatic) and thereby provide an epoxy resin powder coating composition (3) with a 90% volume particle diameter of 59 μm and a gel time of 43 seconds at 180° C.

Production Example 4

Production of an Epoxy Resin Powder Coating Composition

Using Supermixer (Nippon Spindle Mfg. ), 100 parts by weight of epoxy resin (EPIKOTE 1004F, Yuka-Shell Epoxy), 30 parts by weight of curing agent (EPICURE 172, Yuka-Shell Epoxy), 5 parts by weight of calcium carbonate, and 20 parts by weight of titanium dioxide were admixed for about 1 minute. Then, using Co-kneader (Buss), the mixture was melt-kneaded at about 95° C. After cooling at room temperature and crude pulverization, the pulverizate was further comminuted with Atomizer (Fuji Paudal) and classified to remove coarse particles with a pneumatic classify apparatus DS-2 (Nippon Pneumatic) and thereby provide an epoxy resin powder coating composition (4) with a 90% volume particle diameter of 62 μm and a gel time of 34 seconds at 180° C.

Production Example 5

Production of an Epoxy Resin Powder Coating Composition

Using Supermixer (Nippon Spindle Mfg.), 100 parts by weight of epoxy resin (EPIKOTE 1003F, Yuka-Shell Epoxy), 30 parts by weight of curing agent (EPICURE 170, Yuka-Shell Epoxy), 0.2 parts by weight of curing catalyst (CURESOL C17Z, Shikoku Kasei Kogyo), 5 parts by weight of calcium carbonate, and 20 parts by weight of titanium dioxide were admixed for about 1 minute. Then, using Co-kneader (Buss), the mixture was melt-kneaded at about 95° C. After cooling at room temperature and crude pulverization, the pulverizate was further comminuted with Atomizer (Fuji Paudal) and classified to remove coarse particles with a pneumatic classify apparatus DS-2 (Nippon Pneumatic) and thereby provide an epoxy resin powder coating composition (5) with a 90% volume particle diameter of 55 μm and a gel time of 442 seconds at 180° C.

Production Example 6

Production of an Epoxy Resin Powder Coating Composition

Using Supermixer (Nippon Spindle Mfg.), 100 parts by weight of epoxy resin (EPIKOTE 1004F, Yuka-Shell Epoxy), 23 parts by weight of curing agent (EPICURE 170, Yuka-Shell Epoxy), 7 parts by weight of curing agent (EPICURE 172, Yuka-Shell Epoxy), 5 parts by weight of calcium carbonate, and 20 parts by weight of titanium dioxide were admixed for about 1 minute. Then, using Co-kneader (Buss), the mixture was melt-kneaded at about 95° C. After cooling at room temperature and crude pulverization, the pulverizate was further comminuted with Atomizer (Fuji Paudal) and classified to remove coarse particles with a pneumatic classify apparatus DS-2 (Nippon Pneumatic) and thereby provide an epoxy resin powder coating composition (6) with a 90% volume particle diameter of 65 μm and a gel time of 197 seconds at 180° C.

Production Example 7

Production of an Epoxy Resin Powder Coating Composition

Except that the pneumatic classification procedure was omitted, the procedure of Production Example 1 was otherwise repeated to provide an epoxy resin powder coating composition (7) with a 90% volume particle diameter of 77 μm and a gel time of 71 seconds at 180° C.

Production Example 8

Production of a Dicyandiamide-Curable Epoxy Resin Powder Coating Composition

Using Supermixer (Nippon Spindle Mfg.), 100 parts by weight of epoxy resin (EPIKOTE 1004F, Yuka-Shell Epoxy), 4 parts by weight of curing agent (dicyandiamide), 0.5 parts by weight of curing catalyst (CURESOL 2MZ, Shikoku Kasei Kogyo), 5 parts by weight of calcium carbonate, and 15 parts by weight of titanium dioxide were admixed for about 1 minute. Then, using Co-kneader (Buss), the mixture was melt-kneaded at about 95° C.

After cooling at room temperature and crude pulverization, the pulverizate was further comminuted with Atomizer (Fuji Paudal) and classified to remove coarse particles with a pneumatic classify apparatus DS-2 (Nippon Pneumatic) and thereby provide an epoxy resin powder coating composition (8) with a 90% volume particle diameter of 57 μm and a gel time of 92 seconds at 180° C.

Production Example 9

Production of a Polyester Resin Powder Coating Composition

Using Supermixer (Nippon Spindle Mfg.), 50 parts by weight of polyester resin (Finedic M8024, Dainippon Ink and Chemicals), 30 parts by weight of curing agent (Aduct B-1540, Huls), 6 parts by weight of calcium carbonate, 35 parts by weight of titanium dioxide, and 0.6 parts by weight of surface conditioner (CF-1056, Toshiba Silicone) were admixed for about 2 minutes. Then, using Co-kneader (Buss), the mixture was melt-kneaded at about 100° C. After cooling at room temperature and crude pulverization, the pulverizate was further comminuted with Atomizer (Fuji Paudal) to provide a polyester resin powder coating composition (1) with a volume average particle diameter of 23 μm and a gel time of 259 seconds at 180° C.

Production Example 10

Production of a Polyester Resin Powder Coating Composition

Using Supermixer (Nippon Spindle Mfg.), 60 parts by weight of polyester resin (FINEDIC M8020, Dainippon Ink and Chemicals), 10 parts by weight of curing agent (ADUCT B-1530, Huls), 0.4 parts by weight of curing catalyst (NEOSTAN U-100, Nitto Kasei), 5 parts by weight of calcium carbonate, 30 parts by weight of titanium dioxide, and 0.5 parts by weight of surface conditioner (CF-1056, Toshiba Silicone) were mixed for about 2 minutes. Then, using Co-kneader (Buss), the mixture was melt-kneaded at about 100° C. After cooling at room temperature and crude pulverization, the pulverizate was further comminuted with an atomizer (Fuji Paudal) to provide a polyester resin powder coating composition (2) with a volume average particle diameter of 25 μm and a gel time of 195 seconds at 180° C.

Production Example 11

Production of a Polyester Resin Powder Coating Composition

Using Supermixer (Nippon Spindle Mfg.), 60 parts by weight of polyester resin (FINEDIC M8020, Dainippon Ink and Chemicals), 10 parts by weight of curing agent (ADUCT B-1530, Huls), 0.5 parts by weight of curing catalyst (Neostan U-100, Nitto Kasei), 5 parts by weight of calcium carbonate, 30 parts by weight of titanium dioxide, and 0.5 parts by weight of surface conditioner (CF-1056, Toshiba Silicone) were admixed for about 2 minutes. Then, using Co-kneader (Buss), the mixture was melt-kneaded at about 100° C. After cooling at room temperature and crude pulverization, the pulverizate was further comminuted with Atomizer (Fuji Paudal) to provide a polyester resin powder coating composition (3) with a volume average particle diameter of 25 μm and a gel time of 150 seconds at 180° C.

Production Example 12

Production of a Polyester Resin Powder Coating Composition

Using Supermixer (Nippon Spindle Mfg.), 60 parts by weight of polyester resin (FINEDIC M8020, Dainippon Ink and Chemicals), 10 parts by weight of curing agent (ADUCT B-1530, Huls), 0.15 parts by weight of curing catalyst (NEOSTAN U-100, Nitto Kasei), 5 parts by weight of calcium carbonate, 30 parts by weight of titanium dioxide, and 0.5 parts by weight of surface conditioner (CF-1056, Toshiba Silicone) were admixed for about 2 minutes. Then, using Co-kneader (Buss), the mixture was melt-kneaded at about 100° C. After cooling at room temperature and crude pulverization, the pulverizate was further comminuted with atomizer (Fuji Paudal) to provide a polyester resin powder coating composition (4) with a volume average particle diameter of 21 μm and a gel time of 490 seconds at 180° C.

Production Example 13

Production of a Polyester Resin Powder Coating Composition

Except that a centrifugal pulverizer ZM-1000 (Nippon Seiki Seisakusho) was used for pulverization, the procedure of Production Example 9 was otherwise repeated to provide a polyester resin powder coating composition (5) with a 90% volume average particle diameter of 39 μm and a gel time of 259 seconds at 180° C.

Production Example 14

Production of a Polyester Resin Powder Coating Composition

Using Supermixer (Nippon Spindle Mfg.), 60 parts by weight of polyester resin (FINEDIC M8020, Dainippon Ink and Chemicals), 10 parts by weight of curing agent (ADUCT B-1530, Huls), 0.10 part by weight of curing catalyst (NEOSTAN U-100, Nitto Kasei), 5 parts by weight of calcium carbonate, 30 parts by weight of titanium dioxide, and 0.5 parts by weight of surface conditioner (CF-1056, Toshiba Silicone) were admixed for about 2 minutes. Then, using Co-kneader (Buss), the mixture was melt-kneaded at about 100° C. After cooling at room temperature and crude pulverization, the pulverizate was further comminuted with Atomizer (Fuji Paudal) to provide a polyester resin powder coating composition (6) with a volume average particle diameter of 22 μm and a gel time of 560 seconds at 180° C.

Production Example 15

Production of an Epoxy Resin Powder Coating Composition

Using Supermixer (Nippon Spindle Mfg.), 100 parts by weight of epoxy resin (EPIKOTE 1004F, Yuka-Shell Epoxy), 23 parts by weight of curing agent (EPICURE 170, Yuka-Shell Epoxy), 7 parts by weight of curing agent (EPICURE 172, Yuka-Shell Epoxy), 5 parts by weight of calcium carbonate, and 20 parts by weight of titanium dioxide were admixed for about 1 minute. Then, using Co-kneader (Buss), the mixture was melt-kneaded at about 95° C. After cooling at room temperature and crude pulverization, the pulverizate was further comminuted with Atomizer (Fuji Paudal) to provide an epoxy resin powder coating composition (9) with a volume average particle diameter of 25 μm and a gel time of 197 seconds at 180° C.

Production Example 16

Production of a Polyester Resin Powder Coating Composition

Using Supermixer (Nippon Spindle Mfg.), 60 parts by weight of polyester resin (FINEDIC M8020, Dainippon Ink and Chemicals), 10 parts by weight of curing agent (ADUCT B-1530, Huls), 0.4 parts by weight of curing catalyst (NEOSTAN U-100, NittoKasei), 5 parts by weight of calcium carbonate, 30 parts by weight of titanium dioxide, and 0.5 parts by weight of surface conditioner (CF-1056, Toshiba Silicone) were admixed for about 2 minutes. Then, using Co-kneader (Buss), the mixture was melt-kneaded at about 100° C. After cooling at room temperature and crude pulverization, the pulverizate was further comminuted with Atomizer (Fuji Paudal) and classified to remove coarse particles with a pneumatic classify apparatus DS-2 (Nippon Pneumatic) and thereby provide a polyester resin powder coating composition (7) with a 90% volume particle diameter of 64 μm and a gel time of 195 seconds at 180° C.

In Production Examples 1 to 16, the volume average particle diameters and 90% volume particle diameters of the respective powder coating compositions were determined using the following particle distribution analyzer under the conditions described below.

Particle Distribution Analyzer:

MICROTRAC HRA X-100, manufactured by Nikkiso

Analytical Software

MICROTRAC D. H. S. X100 Data Handling System SD-9300PRO-100

Measuring Conditions

Reflection of Particle Transparency

Sample Dispersing Conditions

Each sample, 0.5 g, was placed in 50 g of 0.1% aqueous surfactant solution and dispersed by means of an ultrasonic washer (SILENTSONIC UT-105, Sharp) for 3 minutes to prepare a test sample.

In Production Examples 1 to 16, the gel time was measured at 180° C. using a gelation tester (Nisshin Scientific).

Example 1

A 0.8 mm-thick zinc phosphate-treated steel sheet was coated with the epoxy resin powder coating composition (1) prepared in Production Example 1 in a cured film thickness of 30±5 μm by electorstastic coating to provide a first coating layer. After half-baking the resultant coat at 100° C. for 5 minutes and cooling down to room temperature, the polyester resin powder coating composition (1) obtained in Production Example 9 was applied in a cured film thickness of 50±5 μm onto the surface of the first coat layer by electrostatic coating to provide a second coating layer. The coated steel sheet was baked in a hot-blast drying oven at a baking temperature of 180° C. for 25 minutes to provide a coating film test piece.

Example 2

Using the epoxy resin powder coating composition (6) obtained in Production Example 6 in lieu of the epoxy resin powder coating composition (1) obtained in Production Example 1, the procedure of Example 1 was otherwise repeated to provide a coating film test piece.

Example 3

Using the epoxy resin powder coating composition (3) obtained in Production Example 3 in lieu of the epoxy resin powder coating composition (1) obtained in Production Example 1 and the polyester resin powder coating composition (2) obtained in Production Example in lieu of the polyester resin powder coating composition (1) obtained in Production Example 9, the procedure of Example 1 was otherwise repeated to provide a coating film test piece.

Example 4

Using the epoxy resin powder coating composition (7) obtained in Production Example 7 in lieu of the epoxy resin powder coating composition (1) obtained in Production Example 1, the procedure of Example 1 was otherwise repeated to provide a coating film test piece.

Example 5

Using the polyester resin powder coating composition (5) obtained in Production Example 13 in lieu of the polyester resin powder coating composition (1) obtained in Production Example 9, the procedure of Example 1 was otherwise repeated to provide a coating film test piece.

Example 6

Using the epoxy resin powder coating composition (8) obtained in Production Example 8 in lieu of the epoxy resin powder coating composition (1) obtained in Production Example 1, the procedure of Example 1 was otherwise repeated to provide a coating film test piece.

Comparative Example 1

Using the epoxy resin powder coating composition (2) obtained in Production Example 2 in lieu of the epoxy resin powder coating composition (1) obtained in Production Example 1, the procedure of Example 1 was otherwise repeated to provide a coating film test piece.

Comparative Example 2

Using the epoxy resin powder coating composition (3) obtained in Production Example 3 in lieu of the epoxy resin powder coating composition (1) obtained in Production Example 1, the procedure of Example 1 was otherwise repeated to provide a coating film test piece.

Comparative Example 3

Using the epoxy resin powder coating composition (4) obtained in Production Example 4 in lieu of the epoxy resin powder coating composition (1) obtained in Production Example 1 and the polyester resin powder coating composition (3) obtained in Production Example 11 in lieu of the polyester resin powder coating composition (1) obtained in Production Example 9, the procedure of Example 1 was otherwise repeated to provide a coating film test piece.

Comparative Example 4

Using the epoxy resin powder coating composition (5) obtained in Production Example 5 in lieu of the epoxy resin powder coating composition (1) obtained in Production Example 1 and the polyester resin powder coating composition (4) obtained in Production Example 12 in lieu of the polyester resin powder coating composition (1) obtained in Production Example 9, the procedure of Example 1 was otherwise repeated to provide a coating film test piece.

Comparative Example 5

Using the epoxy resin powder coating composition (2) obtained in Production Example 2 in lieu of the epoxy resin powder coating composition (1) obtained in Production Example 1 and the polyester resin powder coating composition (6) obtained in Production Example 14 in lieu of the polyester resin powder coating composition (1) obtained in Production Example 9, the procedure of Example 1 was otherwise repeated to provide a coating film test piece.

Comparative Example 6

Using the epoxy resin powder coating composition (9) obtained in Production Example 15 in lieu of the polyester resin powder coating composition (1) obtained in Production Example 9, the procedure of Example 1 was otherwise repeated to provide a coating film test piece.

Comparative Example 7

Using the polyester resin powder coating composition (7) obtained in Production Example 16 in lieu of the epoxy resin powder coating composition (1) obtained in Production Example 1, the procedure of Example 1 was otherwise repeated to provide a coating film test piece.

Comparative Example 8

The procedure of Example 1 was repeated to provide a coating film test piece, except no half-baking process.

Comparative Example 9

Compared With the Method of Japanese Kokai Publication Hei-6-304519

Using Supermixer (Nippon Spindle Mfg.), 100 parts by weight of epoxy resin (EPIKOTE 1004F, Yuka-Shell Epoxy), 6 parts by weight of dihydrazide adipate as a curing agent, 1 part by weight of carbon black, 50 parts by weight of titanium dioxide, and 0.5 parts by weight of benzoin were admixed for about 1 minute. Then, using Co-kneader (Buss), the mixture was melt-kneaded at about 95° C. After cooling at room temperature and crude pulverization, the pulverizate was further comminuted with Atomizer (Fuji Paudal) and classified to remove coarse particles with a pneumatic classify apparatus DS-2 (Nippon Pneumatic) to provide an epoxy resin powder coating composition (a-1) with a 90% volume average particle diameter of 60 μm and a gel time of 210 seconds at 180° C.

Using Supermixer (Nippon Spindle Mfg.), 60 parts by weight of polyester resin (ER6570, Nihon Ester), 12 parts by weight of curing agent (ADUCT B-1530, Huls), 0.6 parts by weight of dibutyl tin dilaurate, 30 parts by weight of titanium dioxide, 0.3 parts by weight of benzoin and 0.6 parts by weight of surface conditioner (MODA FLOW, Mitsubishi Monsanto) were admixed for about 1 minutes. Then, using Co-kneader (Buss), the mixture was melt-kneaded at about 95° C. After cooling at room temperature and crude pulverization, the pulverizate was further comminuted with Atomizer (Fuji Paudal) to thereby provide a polyester resin powder coating composition (b-1) with a volume particle diameter of 24 μm and a gel time of 50 seconds at 180° C.

Using the epoxy resin powder coating composition (a-1) in lieu of the epoxy resin powder coating composition (1) obtained in Production Example 1 and the polyester resin powder coating composition (b-1) in lieu of the polyester resin powder coating composition (1) obtained in Production Example 9, the procedure of Example 1 was otherwise repeated to provide a coating film test piece.

Comparative Example 10

Compared With the Method of Japanese Kokai Publication Hei-6-256692

Using Supermixer (Nippon Spindle Mfg.), 100 parts by weight of epoxy resin (EPIKOTE 1004F, Yuka-Shell Epoxy), 7 parts by weight of curing agent (EPICURE 108FF, Yuka-Shell Epoxy), 40 parts by weight of magnesium silicate, 20 parts by weight of titanium dioxide, and 1 part by weight of surface conditioner (ACRONAL 4F, BASF) were admixed for about 1 minute. Then, using Co-kneader (Buss), the mixture was melt-kneaded at about 95° C. After cooling at room temperature and crude pulverization, the pulverizate was further comminuted with Atomizer (Fuji Paudal) and classified to remove coarse particles with a pneumatic classify apparatus DS-2 (Nippon Pneumatic) to provide an epoxy resin powder coating composition (a-2) with a 90% volume average particle diameter of 65 μm and a gel time of 175 seconds at 180° C.

Using Supermixer (Nippon Spindle Mfg.), 60 parts by weight of polyester resin (FINEDIC M8010, Dainippon Ink and Chemicals), 18 parts by weight of curing agent (ADUCT B-1530, Huls), 18 parts by weight of titanium dioxide and 0.6 parts by weight of surface conditioner (ACRONAL 4F, BASF) were admixed for about 1 minutes. Then, using Co-kneader (Buss), the mixture was melt-kneaded at about 95° C. After cooling at room temperature and crude pulverization, the pulverizate was further comminuted with Atomizer (Fuji Paudal) and thereby provide a polyester resin powder coating composition (b-2) with a volume particle diameter of 26 μm and a gel time of 820 seconds at 180° C.

Using the epoxy resin powder coating composition (a-2) in lieu of the epoxy resin powder coating composition (1) obtained in Production Example 1 and the polyester resin powder coating composition (b-2) in lieu of the polyester resin powder coating composition (1) obtained in Production Example 9, the procedure of Example 1 was otherwise repeated to provide a coating film test piece.

Using the test pieces prepared in Example 1 to 6 and Comparative Examples 1 to 10, the coating film was visually evaluated for appearance of the coating film, in terms of graining, strain, shrinkage, and surface roughness, and the chipping resistance, corrosion resistance, and weather resistance of the film were also evaluated. Evaluation of the appearance of the coating film The graining, strain, and shrinkage of the coating film was visually evaluated on the following rating scale. The results are presented in Table 1. The surface roughness of the coating film was also measured with a surface configuration analyzer and evaluated in the unit of Ra value.

(i) Criteria of Graining

○: smooth without graining

Δ: some graining, yet practically acceptable

×: a lot of graining, practically objectionable (ii) Criteria of Strain

○: smooth without strain

Δ: some small strains, yet practically acceptable

×: many large strains, practically objectionable (iii) Criteria of Shrinkage

○: smooth without shrinkage

Δ: some shrinkage, yet practically acceptable

×: much shrinkage, practically objectionable (iv) Evaluation of Surface Roughness The Ra value was measured with a surface configuration analyzer (SURFCOM 470A, Tokyo Precision). The measurement of Ra value was carried out at a cutoff value of 0.8 mm and a scanning speed of 0.3 mm/sec. The data are shown in Table 1. When Ra value is 0 to 0.5 μm, it means a good appearance of the coating film, and Ra value which exceeds 0.5 and is not greater than 0.8 μm is practically acceptable.

Evaluation of Chipping Resistance

With the test pieces of Examples 1 to 6 and Comparative Examples 1 to 10 being held at a temperature of 0° C., 50 g of No. 7 pebbles were pneumatically thrown under an air pressure of 4 kg/cm$^2$ against each test piece at right angles and the degree of chipping of the coating film was evaluated on the following criteria [chipping resistance (1)]. On the other hand, a solvent-based color coating (SUPERLAC M-100 Black, Nippon Paint) was applied in a dry film thickness of 15±5 μm onto each of the test pieces of Examples 1 to 6 and Comparative Examples 1 to 10 and allowed to set at room temperature for 10 minutes. Then, a solvent-based clear coating (SUPERLAC O-100 Clear, Nippon Paint) was further applied in a dry film thickness of 30±5 μm and allowed to set at room temperature for 10 minutes. The test piece thus coated was baked at 140° C. for 20 minutes to provide a multi-layer coating film. Those test pieces were also evaluated for chipping resistance in the same manner as above [chipping resistance (2)]. The results are respectively shown in Table 1.

○: no chipping exposing the substrate

Δ: one or two chippings exposing the substrate which are not greater than 2 mm×2 mm ×: three or more chippings exposing the substrate which are not greater than 2 mm×2 mm or one or more chippings exposing the substrate which are greater than 2 mm×2 mm.

Evaluation of Corrosion Resistance

Using the test pieces obtained in Examples 1 to 6 and Comparative Examples 1 to 10, the 500-hours test was performed using the apparatus and conditions directed in JIS K5400 9.1. The results were expressed in the distance (mm) of progression of rust from the incision with a Cutter Knife (trademark). The data are presented in Table 1. When the distance of progression of rust was not more than 1 mm, the test piece was evaluated as being acceptable.

Evaluation of Weather Resistance

Using the test pieces obtained in Examples 1 to 6 and Comparative Examples 1 to 10, the 500-hour test was performed using the apparatus and conditions directed in JIS K5400 9.8.1. The results were expressed in the retention ratio of 60° gloss. The data are presented in Table 1.

When the 60° gloss % retention ratio value was not less than 70%, the test piece was evaluated as being acceptable.

drying oven at a baking temperature of 180° C. for 25 minutes to provide a coating film test piece.

This test piece was coated with the electrodeposition coating except a part coated with the powder coating. The part of electrodeposition coating is the part uncoated with the powder coating by the masking tape and the reverse of the powder coating side. The appearance of the powder coating part and the electrodeposition coating part is excellent respectively by visual comparison.

From the above results, it was found that both weather resistance and corrosion resistance are unsatisfactory when the two layers are derived from epoxy resin powder coatings (Comparative Example 6) or the two layers are derived from polyester resin powder coatings (Comparative Example 7). It was also found that even in cases in which the first layer is derived from an epoxy resin powder coating and the second layer is derived from a polyester resin powder coating, when the gel time of the powder coating forming the first layer exceeds 400 seconds as in Comparative

| | | Example | | | | | | Comparative Example | | | | | | | | | |
|---|---|---|---|---|---|---|---|---|---|---|---|---|---|---|---|---|---|
| | | 1 | 2 | 3 | 4 | 5 | 6 | 1 | 2 | 3 | 4 | 5 | 6 | 7 | 8 | 9 | 10 |
| | | Production Example | | | | | | | | | | | | | | | |
| First layer | | 1 | 6 | 3 | 7 | 1 | 8 | 2 | 3 | 4 | 5 | 2 | 1 | 16 | 1 | a-1 | a-2 |
| | | Production Example | | | | | | | | | | | | | | | |
| Second layer | | 9 | 9 | 10 | 9 | 13 | 9 | 9 | 9 | 11 | 12 | 14 | 15 | 9 | 9 | b-1 | b-2 |
| First layer | 90% Volume particle diameter | 62 | 65 | 59 | 77 | 62 | 57 | 60 | 59 | 62 | 55 | 60 | 62 | 64 | 62 | 60 | 65 |
| | Gel time (A) (sec) | 71 | 197 | 43 | 71 | 71 | 92 | 285 | 43 | 34 | 442 | 285 | 71 | 195 | 71 | 210 | 175 |
| Second layer | Volume average particle | 23 | 23 | 25 | 23 | 39 | 23 | 23 | 23 | 25 | 21 | 22 | 25 | 23 | 23 | 24 | 26 |
| | Gel time (B) (sec) | 259 | 259 | 195 | 259 | 259 | 259 | 259 | 259 | 150 | 490 | 560 | 197 | 259 | 259 | 50 | 820 |
| Gel time ratio (A)/(B) | | 1.0/3.6 | 1.0/1.3 | 1.0/4.5 | 1.0/3.6 | 1.0/3.6 | 1.0/2.8 | 1.1/1.0/ | 1.0/6.0 | 1.0/4.4 | 1.0/1.1 | 1.0/2.0 | 1.0/2.8 | 1.0/1.3 | 1.0/3.6 | 4.2/1.0/ | 1.0/4.7 |
| Appearance | Ra (μm) | 0.3 | 0.3 | 0.4 | 0.5 | 0.7 | 0.3 | 0.6 | 0.6 | 1.1 | 0.3 | 0.2 | 0.9 | 0.2 | 1.5 | 1.2 | 0.3 |
| | Graining | ○ | ○ | ○ | Δ | ○ | ○ | ○ | ○ | ○ | ○ | ○ | ○ | ○ | ○ | ○ | ○ |
| | Strain | ○ | ○ | ○ | ○ | ○ | ○ | x | ○ | ○ | Δ | ○ | ○ | ○ | ○ | x | ○ |
| | Shrinkage | ○ | ○ | ○ | ○ | ○ | ○ | ○ | x | ○ | ○ | ○ | ○ | ○ | ○ | ○ | ○ |
| Chipping resistance (1) | | ○ | ○ | ○ | ○ | ○ | Δ | x | x | ○ | x | x | ○ | x | ○ | x | x |
| Chipping resistance (2) | | ○ | ○ | ○ | ○ | ○ | Δ | x | x | ○ | x | x | ○ | x | ○ | x | x |
| Corrosion resistance (mm) | | 0.5 | 0.4 | 0.6 | 0.5 | 0.5 | 0.4 | 0.4 | 0.7 | 0.8 | 3.8 | 3.1 | 0.3 | 2.6 | 0.5 | 0.3 | 2.0 |
| Weather resistance (%) | | 84 | 88 | 85 | 76 | 81 | 84 | 79 | 86 | 83 | 58 | 44 | 13 | 88 | 83 | 75 | 32 |

Example 11

Powder/Electrodeposition Inverse-Coating

A 0.8 mm-thick zinc phosphate-treated steel sheet, which is partly covered with a masking tape, was coated with the epoxy resin powder coating composition (1) prepared in Production Example 1 in a cured film thickness of 30±5 μm by electrostatic coating to provide a first coating layer. After half-baking the resultant coat at 100° C. for 5 minutes and cooling down to room temperature, the polyester resin powder coating composition (1) obtained in Production Example 9 was applied in a cured film thickness of 50±5 μm onto the surface of the first coat layer by electrostatic coating to provide a second coating layer. The resultant coat was half-baked at 100° C. for 5 minutes and cooling down to room temperature. After the masking tape was peeled off, a cationic electrodeposition coating (POWER TOP V-50, Nippon Paint) is electrodeposited at 230 V for 3 minutes in a bath at 28° C. The coated steel sheet was baked in a hot-blast Example 4 or the gel time of the powder coating forming the second layer exceeds 500 seconds as in Comparative Example 5, both corrosion resistance and weather resistance are unsatisfactory. In Comparative Example 1 and Comparative Example 2 wherein the gel time ratio (A)/(B) of the powder coatings forming the first and second layers is outside the range of 1/1 through 1/5, graining and shrinkage occurred to detract from the appearance of the coating film and the chipping resistance was also poor. In Comparative Example 3, wherein the gel time ratio (A)/(B) was within the above-mentioned range but the gel time of the powder coating forming the first layer was less than 40 seconds, the film surface was too rough to be practically acceptable.

While the appearance of the coating film, corrosion resistance, weatherresistance, and chipping resistance were all satisfactory in Examples 1 to 6, the corresponding test pieces further coated with the solid color paint and clear coat paint and baked to form a multi-layer film were also satisfactory in chipping resistance, indicating good adhesion to those paints and attesting to the usefulness of the coating film of the invention as an anti-chipping primer.

In Comparative Example 8, the second layer was applied onto the no half-baked first layer, and therefore, the powder coatings of the second layer appeared to partially get into the powder coatings of the first layer, with result in poor Ra.

Compared with a method of Japanese Kokai Publication Hei-6-304519, Comparative Example 9 is not satisfied in Ra and chipping resistance. This shows that the control of gel time ratio (A)/(B) is more effective for Ra and chipping resistance than the control of surface tension of the film.

On the other hand, compared with a method of Japanese Kokai Publication Hei-6-256692, the gel time of epoxy resin powder coating (a-2) in Comparative Example 10 exceeds 400 seconds so that it is not able to get a film which cured completely.

Having the above constitution, the method for forming a coating film of the present invention, the 2-coat/1-bake method even containing half-baking process enables implementation of reduced coating process time and reduced energy cost, compared with the conventional 2-coat/2-bake method. Using two kinds of powder coatings which have different abilities, the method provides a coating film with improved corrosion resistance, weather resistance, chipping resistance, and appearance of the coating film. The method for forming a coating film of the invention can be used for Powder/Electrodeposition Inverse-Coating System. This coating film can be used as a primer coat or a top coat in the coating of metallic substrates. Because the coating film is very satisfactory in corrosion resistance, weather resistance, chipping resistance, and appearance of the coating film, it can be used advantageously in outdoor applications, for example road-related materials such as guardrails and road signs, residential building materials, and automotive bodies.

We claim:

1. A method for forming a coating film which comprises applying an epoxy resin powder coating (A) onto a substrate by electrostatic coating, half-baking the resultant coating, applying a polyester resin powder coating (B) onto the half-baked coating by electrostatic coating, and simultaneously baking the coated substrate having the half-baked epoxy and polyester resin powder coating thereon; wherein said epoxy resin powder coating (A) and said polyester resin powder coating (B) are such that the gel time ratio of gel time of epoxy resin powder coating (A)/gel time of polyester resin powder coating (B) at 180° C. is 1/1 through 1/5, the gel time of said epoxy resin powder coating (A) at 180° C. is 40 to 400 seconds, and the gel time of said polyester resin powder coating (B) at 180° C. is not over 500 seconds.

2. The method for forming a coating film according to claim 1 wherein half-baking of the epoxy resin powder coating is performed at 75 to 140° C. for 1 to 15 minutes.

3. The method for forming a coating film according to claim 1 wherein said epoxy resin powder coating (A) has a 90% volume particle diameter of not greater than 70 $\mu$m.

4. The method for forming a coating film according to claim 1 wherein said polyester resin powder coating (B) has a volume average particle diameter of 5 to 30 $\mu$m.

5. The method for forming a coating film according to claim 1 wherein said epoxy resin powder coating (A) is a phenol-curable epoxy resin powder coating.

6. The method for forming a coating film according to claim 1 wherein between applying said polyester resin powder coating (B) and baking the coated substrate with the half-baked epoxy and polyester resin coating thereon, half-baking said polyester resin powder coating (B), and applying an electrodeposition coating onto the half-baked polyester resin powder coating are further performed.

7. A coated substrate obtained by the method of claim 1.

* * * * *